United States Patent [19]

Nahmias

[11] Patent Number: 5,070,945

[45] **Date of Patent: * Dec. 10, 1991**

[54] FIRE FIGHTING METHOD AND USE OF THE METHOD

[75] Inventor: Jean Nahmias, Paris, France

[73] Assignee: Cerberus Guinard, France

[ * ] Notice: The portion of the term of this patent subsequent to Jan. 22, 2008 has been disclaimed.

[21] Appl. No.: 644,960

[22] Filed: Jan. 22, 1991

Related U.S. Application Data

[63] Continuation-in-part of Ser. No. 224,574, Jul. 26, 1988, Pat. No. 4,986,363.

[51] Int. Cl.[5] ..... A62C 2/00; A62C 3/02

[52] U.S. Cl. ..... 169/46; 169/43; 169/45

[58] Field of Search ..... 169/43, 46, 45, 47

[56] References Cited

U.S. PATENT DOCUMENTS

| | | | |
|---|---|---|---|
| 2,858,895 | 11/1958 | Connell | 169/1 |
| 3,684,019 | 8/1972 | Emmons et al. | 169/1 A |
| 4,616,711 | 10/1986 | Johnson | 169/45 |
| 4,986,363 | 1/1991 | Nahmiaj | 169/46 |

FOREIGN PATENT DOCUMENTS

| | | |
|---|---|---|
| 1209202 | 2/1960 | France . |
| 2352870 | 5/1977 | France . |
| 2344302 | 10/1977 | France . |

*Primary Examiner*—Joseph F. Peters, Jr.
*Assistant Examiner*—Anne E. Bidwell
*Attorney, Agent, or Firm*—Eckert, Seamans, Cherin & Mellott

[57] ABSTRACT

The invention relates to a fire fighting method, consisting of using non-propagative elements or of employing means for rendering combustible elements non-propagative in such a manner that the percentage of non-propagative sites which a fire front is likely to encounter is greater than a given threshold of less than 100%.

14 Claims, 1 Drawing Sheet

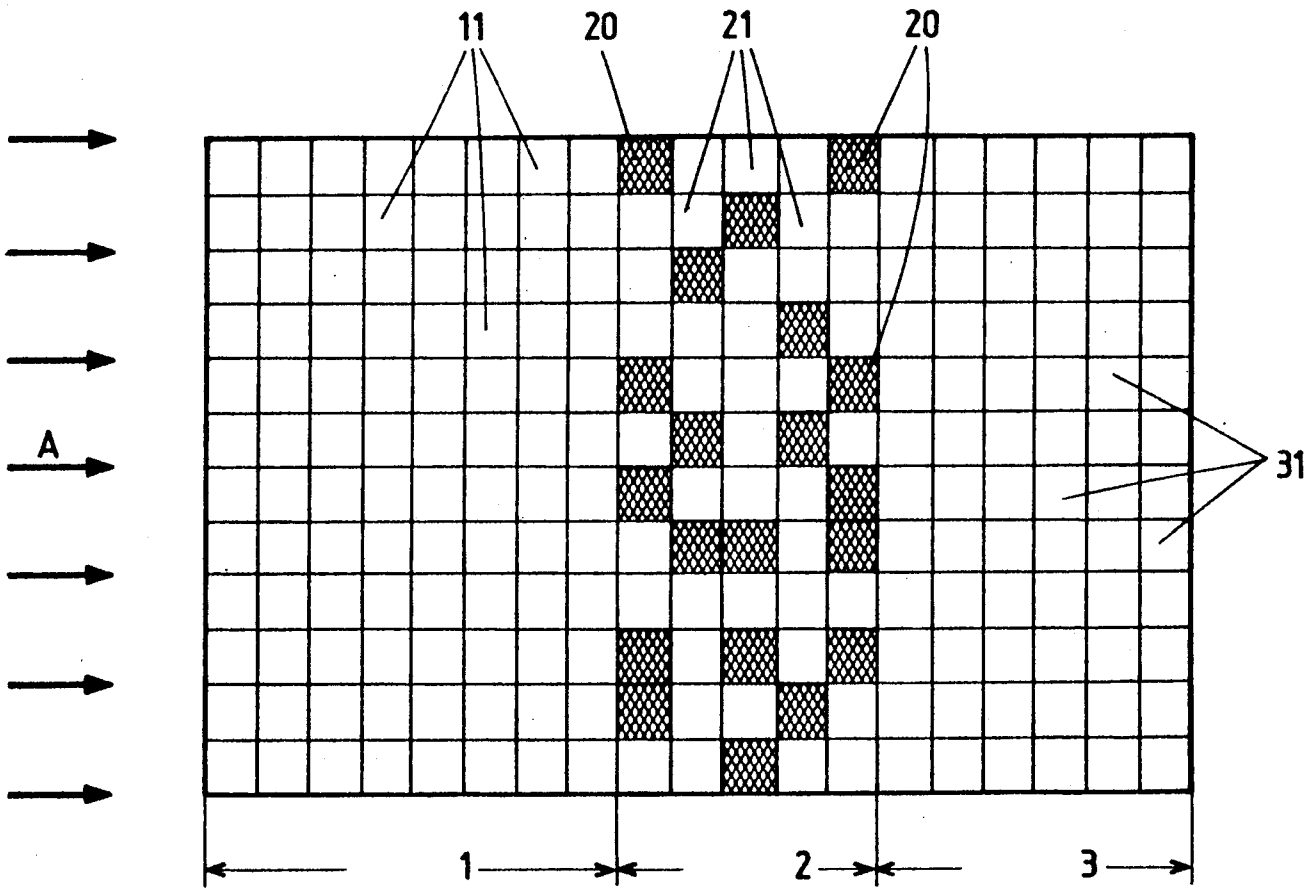
31
20
21
20
11
3
2
1
A

FIRE FIGHTING METHOD AND USE OF THE METHOD

CROSS REFERENCE TO RELATED APPLICATION

The present Application is a continuation-in-part of application Ser. No. 224,574, filed on July 26, 1988, issued as U.S. Pat. No. 4,986,363 on Jan. 22, 1991.

BACKGROUND OF THE INVENTION

1. Field of the Invention

This invention relates to a method for fighting fires, such as forest fires.

2. Prior Art

At present, the means for fighting, for example, forest fires are based on two main principles. The first is preventive and consists of establishing zones in the forest in which the fuel enabling fire to progress (propagative element) is partially or completely removed (fire-break zone).

The second principle consists of fighting by actively working on the front of the fire so as to render the vegetation downstream of the fire non-combustible (non-propagative element) by the application of water, whether or not supplemented with retardant substances. This application can be performed by aircraft or motor driven pumps in such a way that the wet zone is as continuous as possible, or even submerged in water.

These means for prevention and fire fighting have disadvantages. For example, the creation of fire-break zones requires the complete elimination of vegetation from areas which may be of considerable size. This approach can be very costly and prejudicial to nature. Similarly, undergrowth clearance operations have to be frequently repeated to be effective, also resulting in considerable cost. Finally, active intervention necessitates fast and accurate action with continuous and ample supply of fire fighting material. These conditions often put the operators in danger, e.g. by flying aircraft at low altitudes or by placing a large number of operators near the fire. Another disadvantage of the prior art is principally the maximizing of the preventive or fire fighting means so as to be sure of stopping the fire.

SUMMARY OF THE INVENTION

An object of the present invention is to provide a fire fighting method whereby the means for fighting the fire are optimized by applying a theory of percolation. This object is achieved through a fire fighting method which includes using non-propagative elements or employing means for rendering combustible elements non-propagative in such a manner so that the percentage of the non-propagative sites which a fire front is likely to encounter is greater than a given threshold below 100%.

The number of propagative and non-propagative sites is preferably greater than 150 and the number of non-propagative sites preferably varies within a range of between 25 and 60% of the total number of sites. This threshold range of between 25 and 60% is preferably applied to forest fires. The threshold is preferably equal to 42% to stop forest fires in the absence of wind.

Another object of the invention is to provide a preventive fire fighting method by optimizing the means This object is achieved by the fact that the method according to the invention is characterized in that the non-propagative elements ca consist of non-combustible plants planted in the proportions indicated according to a random distribution to optimize and reduce the costs of clearing undergrowth and creating fire-break zones.

Another object of the invention is to provide a method whereby the active means for fire fighting are optimized while reducing the dangers to the operators. This object is achieved through the fact that the means for rendering the elements of a zone non-propagative can consist of spray heads with jets of damping fluid, arranged in such a way that the area sprayed is greater than the given threshold. The means for rendering the elements of a zone non-propagative can also consist of transportable bombs or containers, which can be thrown or released. Water or foam can be used as a damping fluid, and the damping fluid can contain retardants.

BRIEF DESCRIPTIONS OF THE DRAWINGS

Other characteristics and advantages of the present invention will become more clearly apparent upon a reading of the description below with reference to the single figure showing the use of the method of the invention in fire fighting.

FIG. 1 represents the use of the percolation theory in a fire fighting method.

DETAILED DESCRIPTION OF THE PREFERRED EMBODIMENTS

According to the percolation theory, a propagative phenomenon, such as fire, cannot develop in a medium in which the proportion of inactive or non-propagative sites in relation to the active or propagative sites is greater than or equal to a number, which it is appropriate to call the percolation threshold. In the example illustrated in FIG. I, a combustible area, such as a forest, is divided into three zones. A first zone consists exclusively combustible sites (Il). A second zone (2) of width (L) consists a random distribution (20) (sites represented by hatched lines), the proportion of which is greater than the percolation threshold. A third zone (3) consists, like the first, of exclusively combustible sites (31).

It is has been found that a fire spreading in the direction of arrows (A) spreads in zone (1) and is stopped at the level of zone (2) when the proportion of non-propagative sites (20) in relation to the propagative sites (21) exceeds a certain percentage. In this case, the fire does not spread to the interior of zone (3), and the fire stops in zone (2).

Experience has shown that, in the case of a threshold of between 25 and 60% for forest fires, either a slowing or a stopping of the fire is achieved, depending on the wind conditions and on the threshold chosen. Preferably when one wishes to stop a forest fire, in the absence of wind, one will chose a threshold equal to 42%. Advantageously, to have a percolation effect, for a given zone, the number of propagative and non-propagative sites is preferably greater than 150 and the number of propagative sites preferably represents a breaker of between 25 and 60% of the total number of sites, which may represent an equivalent area or volume on the order of between 25 and 60% of the total area or volume of the zone in question.

The non-propagative sites preferably consists either of non-combustible plants planted separately or in thickets among the existing natural vegetation. These plants can be chosen from non-combustible species which are known or which may be developed later.

Another means for rendering the elements of a site non-propagative can consist of installing fixed spray heads or hydrants producing jets of fluid, such as water or foam, which can also contain retardants. These hydrant or spray head elements are brought into action either manually or automatically when the fire approaches, and their distribution is such that the zones sprayed by these elements and rendered non-propagative correspond with the slowing-down threshold or with the stopping threshold of the fire mentioned above. A known automatic control operated from a fire detection device can also be employed to control these spray heads.

It will easily be understood that the method of the invention can also be used for fighting fires in buildings so as to optimize the number of spray heads and detection elements to reduce installation cost and to limit damage due to flooding of the premises. Similarly, the above principle, whereby combustible zones are combined with non-combustible zones, can advantageously be used in the construction of houses to limit the quantity of non-combustible materials required, thereby reducing construction costs without reducing safety and fire prevention.

Another means for rendering sites non-propagative can consist of bombs thrown or released downstream of the front of the fire, dispersing, as they explode, a fluid such as water or foam, which can contain retardants. This means for projecting fluid to damp down the vegetation of the sites and spraying the fluid from the bottom upwards can have the advantage of taking into account the fractile nature of the vegetation, i.e. the arborescent shape of the plants. In this case, spraying performed in the direction of the arborescents provides a much better damping down than that provided, for example, by the spraying or release of water from an aircraft.

Thus, the method used and the various means enabling the method to be put into practice by producing zones of non-propagative elements contribute to the optimization of fire fighting. As discussed above, the present method of fire fighting consists of using non-propagative elements or of employing means for rendering combustible elements non-propagative in such a manner that the percentage of non-propagative sites which a fire front is likely to encounter is greater than a given threshold of less than 100%. One advantage of such a method using the percolation theory is that it ca be used not only as a means for fighting fires but also as a preventive means.

Other modifications within the reach of the specialist also form part of the spirit of the invention. For example, in the case where water bombs are used, a site can be neutralized by exploding an envelope containing a specified quantity of water among the vegetation. This explosion can be caused either by impact with the ground or by remote control at a determined height in relation to the ground. In the case of impact explosion, it is preferable to use bombs with a flexible envelope, whereas rigid envelopes operate better for remotely controlled explosions.

I claim:

1. A method of preventing the spread of fire comprising the steps of:

defining a combustible area having substantially continuous combustible material;

dividing said combustible area into three zones, a first zone and a second zone having a first shared border and a third zone and said second zone having a second shared border;

dividing said second zone into a plurality of site units;

defining a threshold percentage of non-propagative site units necessary to halt fire propagation through said second zone, the percentage of said plurality which are non-propagative site units being a percentage greater than the threshold percentage, but less than 100%, and said non-propagated site units being dispersed within said second zone;

wherein said non-propagated site units do not burn readily;

whereby a fire front will not propagate to said second shared border.

2. The method according to claim 1, wherein said non-propagative site units are treated so as not to burn readily.

3. The method according to claim 1, wherein the non-propagative site units comprise untreated plant material which does not burn readily.

4. The method according to claim 1, wherein the threshold is between 25% and 60%.

5. The method according to claim 1, wherein the threshold is substantially at least 42%, whereby propagation of a forest fire is stopped in the absence of wind.

6. The method according to claim 1, wherein the non-propagative site units are defined by concentrations of non-combustible plants growing in the zone.

7. The method according to claim 1, wherein the non-propagative sites are produced by spraying an area with a non-combustible fluid.

8. The method according to claim 7, wherein the fluid is sprayed by spray heads.

9. The method according to claim 7, wherein the fluid is applied by placing sealed rupturable containers in the zone, whereby the fluid is sprayed when the containers are caused to explode.

10. The method according to claim 7, wherein the fluid is water.

11. The method according to claim 7, wherein the fluid is a foam.

12. The method according to claim 7, wherein the fluid contains fire retardants.

13. The method according to claim 1;, wherein the zones are established within a building.

14. The method according to claim 1, wherein the zones are established in a forest.

* * * * *